US010119687B1

(12) United States Patent
Hsu

(10) Patent No.: US 10,119,687 B1
(45) Date of Patent: Nov. 6, 2018

(54) REVIVAL LAMP WITH SOUNDING EFFECT

(71) Applicant: Dong Guan Bright Yinhuey Lighting Co., Ltd. China, Guang Dong (CN)

(72) Inventor: Kevin Hsu, Taichung (TW)

(73) Assignee: Dong Guan Bright Yinhuey Lighting Co., Ltd., Guang Dong (CN)

( * ) Notice: Subject to any disclaimer, the term of this patent is extended or adjusted under 35 U.S.C. 154(b) by 0 days.

(21) Appl. No.: 15/644,899

(22) Filed: Jul. 10, 2017

(51) Int. Cl.

| | |
|---|---|
| ***F21V 23/00*** | (2015.01) |
| ***F21V 21/22*** | (2006.01) |
| ***F21V 33/00*** | (2006.01) |
| ***F21V 23/04*** | (2006.01) |
| ***F21V 3/02*** | (2006.01) |
| ***F21V 23/06*** | (2006.01) |
| ***F21V 23/02*** | (2006.01) |
| *F21Y 115/10* | (2016.01) |

(52) U.S. Cl.
CPC ..... *F21V 21/22* (2013.01); *F21V 3/02* (2013.01); *F21V 23/02* (2013.01); *F21V 23/04* (2013.01); *F21V 23/06* (2013.01); *F21V 33/0056* (2013.01); *F21Y 2115/10* (2016.08)

(58) Field of Classification Search
CPC ..... F21V 23/02; F21V 23/04; F21V 23/06; F21V 3/02; F21V 21/22; F21V 33/0056; F21Y 2115/10
USPC ..... 362/253
See application file for complete search history.

(56) References Cited

U.S. PATENT DOCUMENTS

| | | | | |
|---|---|---|---|---|
| 2,643,561 | A * | 6/1953 | Ackley | H02G 1/1295 30/90.1 |
| 4,391,496 | A * | 7/1983 | Schilling | G02B 21/025 359/376 |
| 9,820,024 | B1 * | 11/2017 | Rolf | H04R 1/028 |
| 2005/0232808 | A1 * | 10/2005 | Smith | A61L 9/03 422/5 |
| 2009/0073694 | A1 * | 3/2009 | Scannell, Jr. | A47G 7/06 362/253 |
| 2015/0009660 | A1 * | 1/2015 | Lee | F21L 4/00 362/186 |
| 2015/0300581 | A1 * | 10/2015 | Huang | F21L 4/00 362/86 |
| 2015/0369432 | A1 * | 12/2015 | Li | F21S 6/001 362/249.02 |
| 2016/0363312 | A1 * | 12/2016 | You | F21V 33/0056 |

* cited by examiner

*Primary Examiner* — Claude J Brown
(74) *Attorney, Agent, or Firm* — Alan D. Kamrath; Kamrath IP Lawfirm, P.A.

(57) ABSTRACT

A revival lamp includes a housing, a sound assembly mounted in the housing, a light assembly mounted on the housing, and a lampshade covering the light assembly. The light assembly includes an LED and a dimmer. The dimmer includes a rotary knob, a position regulator and a driving gear. The rotary knob is secured to the driving gear. The position regulator has a side provided with an upright toothed rack meshing with the driving gear and has a top provided with a plurality of electric contacts. The LED is mounted on the position regulator and electrically connected with the electric contacts. When the driving gear is rotated by the rotary knob, the toothed rack is moved, the position regulator is moved, and the LED is lifted to protrude from the housing or lowered to retract into the housing.

8 Claims, 7 Drawing Sheets

REVIVAL LAMP WITH SOUNDING EFFECT

BACKGROUND OF THE INVENTION

1. Field of the Invention

The present invention relates to a lighting tool and, more particularly, to a revival lamp with a sounding effect.

2. Description of the Related Art

A conventional lamp comprises a base, a light emitting element mounted on the base, and a lampshade mounted on the base to cover the light emitting element. Thus, the lamp provides a lighting function. However, the conventional lamp does not have a sound playing function, so that it is necessary to mount a sound device additionally so as to provide a sound playing function, thereby wasting the space of storage. In addition, the conventional lamp has a determined brightness that cannot be regulated according to the user's requirement.

BRIEF SUMMARY OF THE INVENTION

The primary objective of the present invention is to provide a light and sound combination that provides illuminating and sound playing functions simultaneously.

In accordance with the present invention, there is provided a lamp comprising a housing, a sound assembly mounted in the housing, a light assembly mounted in the housing and extending outward from a top of the housing, and a lampshade mounted on the housing and covering the light assembly. The light assembly includes an LED and a dimmer electrically connected with the LED. The dimmer includes a rotary knob, a position regulator and a driving gear. The rotary knob is secured to the driving gear. The position regulator has a side provided with an upright toothed rack meshing with the driving gear and has a top provided with a plurality of electric contacts. The LED is detachably mounted on the position regulator and has a bottom electrically connected with the electric contacts of the position regulator. When the driving gear is rotated by the rotary knob, the toothed rack is moved upward or downward, the position regulator is moved upward or downward, and the LED is lifted to protrude outward from the housing or lowered to retract into the housing.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
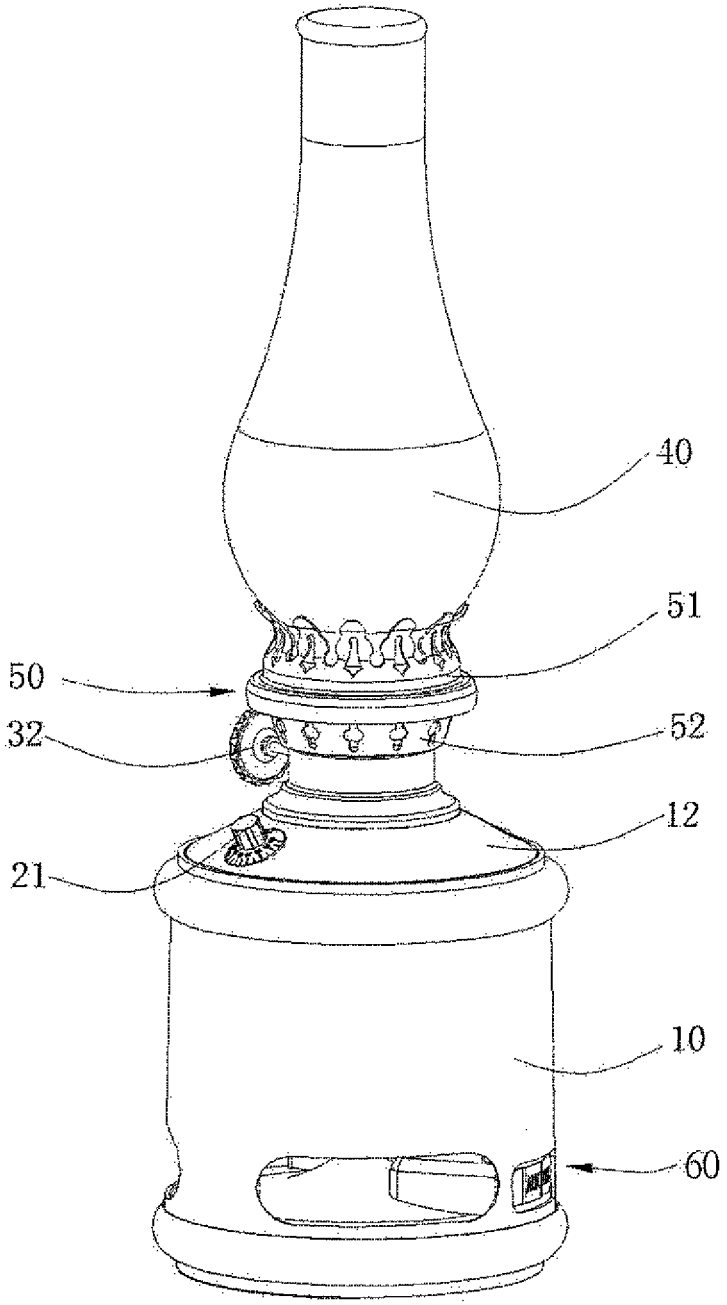
FIG. 1 is a perspective view of a lamp in accordance with the preferred embodiment of the present invention.
Figure 2:
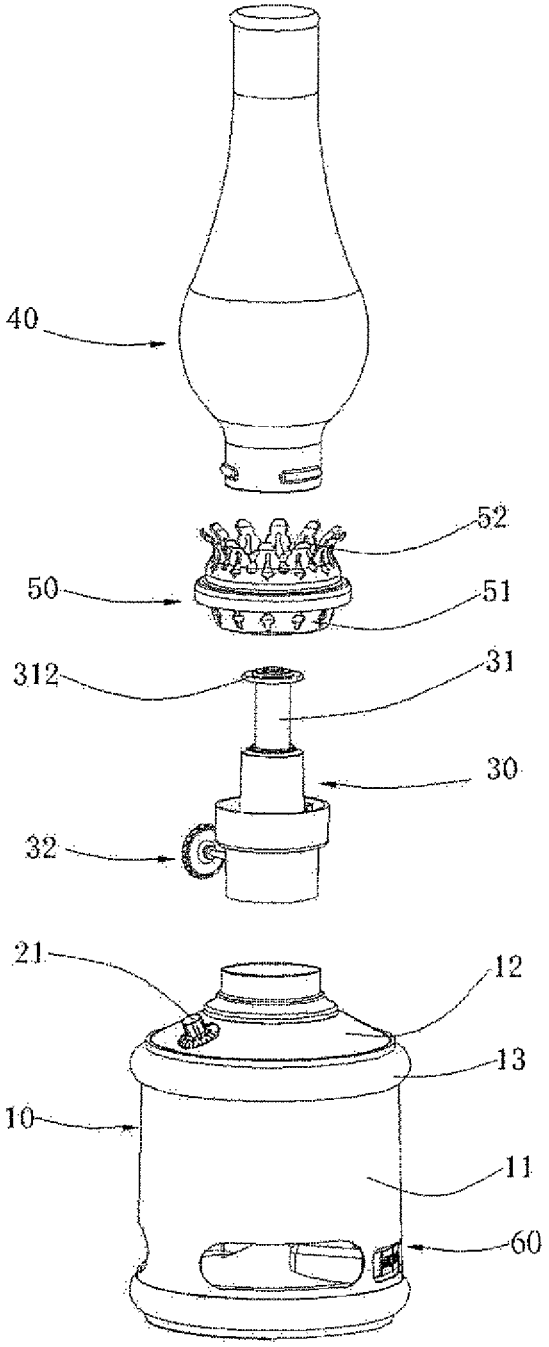
FIG. 2 is an exploded perspective view of the lamp in accordance with the preferred embodiment of the present invention.

Referring to FIGS. 1-7, a lamp in accordance with the present invention comprises a housing 10, a sound assembly 20 mounted in the housing 10, a light assembly 30 mounted in the housing 10 and extending outward from a top of the housing 10, and a lampshade 40 mounted on the housing 10 and covering the light assembly 30. Thus, the revival lamp provides illuminating and sound playing functions.

The light assembly 30 includes an LED (light emitting diode) 31 and a dimmer 32 electrically connected with the LED 31 to turn on/off the LED 31 and to regulate the brightness of the LED 31. The dimmer 32 includes a rotary knob 321, a position regulator 322 and a driving gear 323. The rotary knob 321 is secured to the driving gear 323 and protrudes outward from the housing 10. The driving gear 323 is rotated by rotation of the rotary knob 321. The position regulator 322 has a side provided with an upright toothed rack 324 meshing with the driving gear 323 and has a top provided with a plurality of electric contacts 328. The LED 31 is detachably mounted on the position regulator 322 and has a bottom electrically connected with the electric contacts 328 of the position regulator 322. When the driving gear 323 is rotated by the rotary knob 321, the toothed rack 324 is moved upward or downward, the position regulator 322 is moved upward or downward, and the LED 31 is lifted to protrude outward from the housing 10 or lowered to retract into the housing 10.

In the preferred embodiment of the present invention, the position regulator 322 has an interior provided with an elongate slot 325, and the toothed rack 324 is received in the elongate slot 325. The driving gear 323 extends through the elongate slot 325 of the position regulator 322.

In the preferred embodiment of the present invention, the toothed rack 324 is provided with an upper limit 331 that is movable to rest on the driving gear 323 and a lower limit 332 that is movable to rest on the driving gear 323.

In the preferred embodiment of the present invention, the top of the position regulator 322 is provided with a pedestal 326 having an interior provided with a mounting recess 327, and the electric contacts 328 of the position regulator 322 are located in the mounting recess 327 of the pedestal 326. The bottom of the LED 31 is mounted in the mounting recess 327 of the pedestal 326.

In the preferred embodiment of the present invention, the light assembly 30 further includes a mounting seat 70 mounted on the housing 10, and the LED 31 is movable on the mounting seat 70. The mounting seat 70 has an interior provided with a channel 71, and the position regulator 322 is movable upward or downward in the channel 71 of the mounting seat 70.

Figure 3:
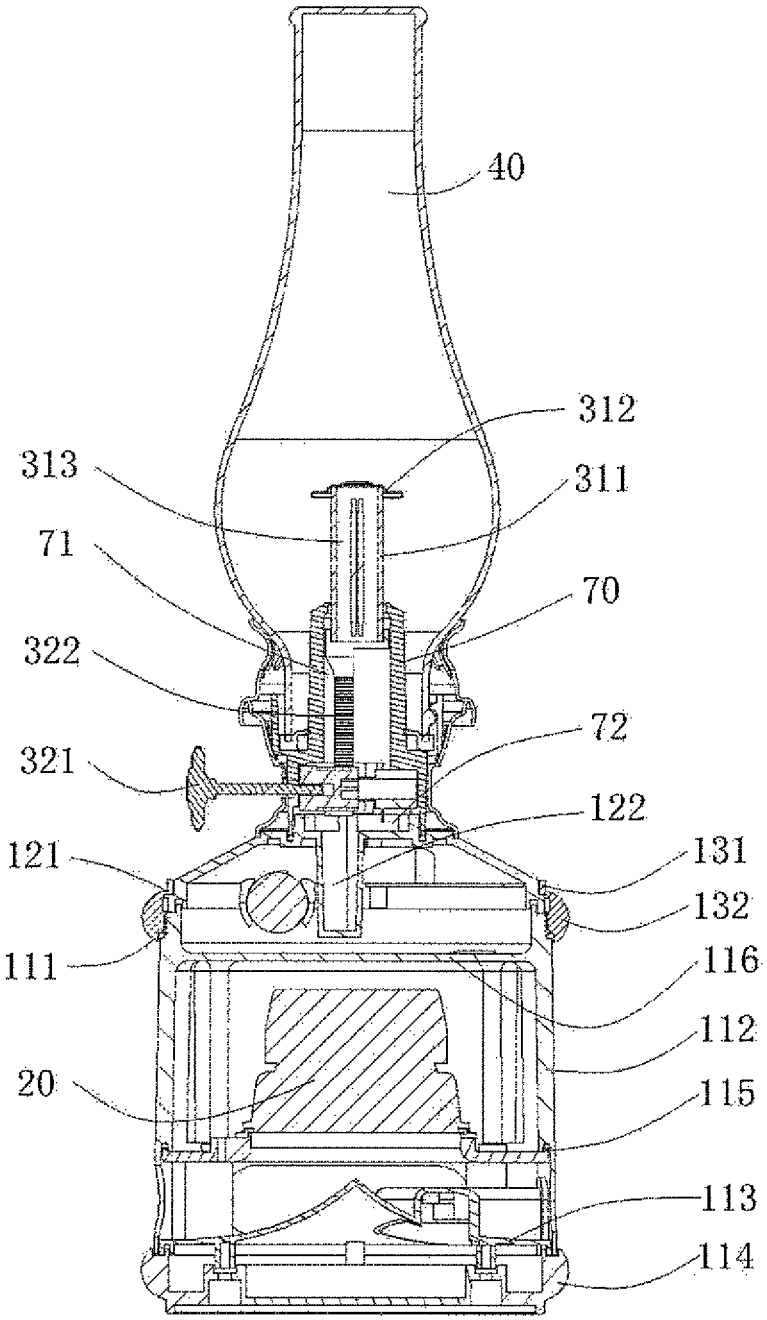
FIG. 3 is a cross-sectional view of the lamp in accordance with the preferred embodiment of the present invention.
Figure 4:
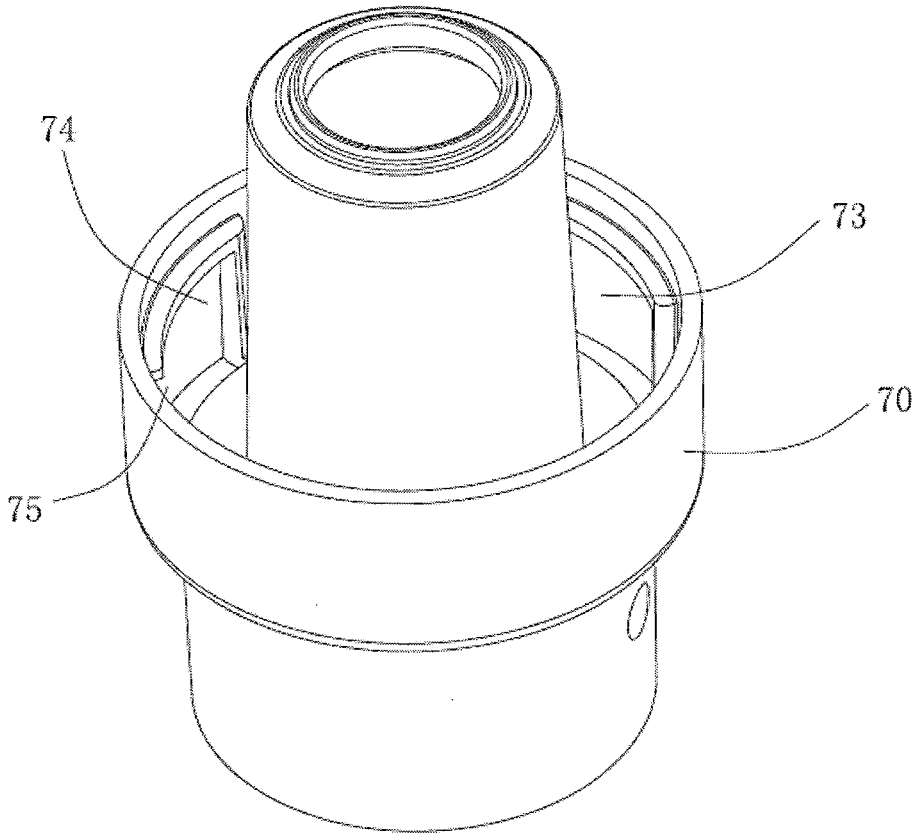
FIG. 4 is a perspective view of a mounting seat of the lamp in accordance with the preferred embodiment of the present invention.

In the preferred embodiment of the present invention, the LED 31 includes a top cap 312 protruding outward from the mounting seat 70 as shown in FIG. 3. The top cap 312 has a diameter greater than that of the channel 71. When the top cap 312 of the LED 31 is moved downward to rest on a top of the mounting seat 70, movement of the LED 31 is stopped, and the position regulator 322 is successively moved downward, so that the bottom of the LED 31 is detached from the electric contacts 328 of the position regulator 322.

In the preferred embodiment of the present invention, the housing 10 includes a main body 11, an upper cover 12 mounted on a top of the main body 11, and a mounting ring 13 located between the main body 11 and the upper cover 12. The mounting seat 70 is mounted on the upper cover 12 of the housing 10.

In the preferred embodiment of the present invention, the main body 11 has an outer face provided with an external thread 111, the upper cover 12 has an outer face provided with a limit plane 121, and the mounting ring 13 has an inner face having an upper end provided with a limit flange 131 locked onto the limit plane 121 of the upper cover 12 and a lower end provided with an arcuate portion 132 provided with an internal thread screwed onto the external thread 111 of the main body 11. The upper cover 12 has a top provided with a guide slot 122 extending downward. When the position regulator 322 is moved downward, the position regulator 322 is retracted into and guided by the guide slot 122 of the upper cover 12. The main body 11 includes an upper casing 112, a support base 113 mounted on the bottom of the upper casing 112, and a bottom casing 114 mounted on the bottom of the support base 113. A chamber is defined between the upper casing 112 and the support base 113. A bottom plate 115 is detachably mounted on the bottom of the upper casing 112. The upper casing 112 has a mediate position provided with a separation plate 116 which separates the upper casing 112 into an upper receiving space for mounting the light assembly 30 and a lower receiving space for mounting the sound assembly 20. The guide slot 122 of the upper cover 12 extends to the lower receiving space of the upper casing 112.

In the preferred embodiment of the present invention, the lamp further comprises an ornament assembly 50 including a first decorative shell 51 and a second decorative shell 52 combined with each other. The first decorative shell 51 is mounted on the upper cover 12 of the housing 10 to cover the mounting seat 70. The second decorative shell 52 is mounted on the lampshade 40.

In the preferred embodiment of the present invention, the sound assembly 20 includes a sound, and a control switch 21 protruding outward from the housing 10 and electrically connected with the sound to turn on/off the sound and to control the volume of the sound. The main body 11 of the housing 10 has a surface provided with a USB (universal serial bus) connecting port 60 electrically connected with the sound of the sound assembly 20, and a USB end cap 61 is mounted in the USB connecting port 60 to cover the USB connecting port 60.

In the preferred embodiment of the present invention, the mounting seat 70 has a bottom mounted on the upper cover 12 of the housing 10. The mounting seat 70 has a top provided with a positioning recess 73 for mounting the lampshade 40. The positioning recess 73 has a peripheral wall provided with a plurality of locking grooves 74 each having an entrance 75. The lampshade 40 is provided with a fitting end mounted in the positioning recess 73 of the mounting seat 70 and provided with a plurality of locking projections locked in the locking grooves 74 of the mounting seat 70. After the fitting end of the lampshade 40 is inserted into the positioning recess 73 of the mounting seat 70, the lampshade 40 is rotated, so that each of the locking projections of the lampshade 40 extends through the entrance 75 into each of the locking grooves 74 of the mounting seat 70 to combine the lampshade 40 and the mounting seat 70. The interior of the mounting seat 70 is further provided with a receiving recess 72 located under and connected to the channel 71. The LED 31 is received in the channel 71 of the mounting seat 70 and further includes a lamp tube 311 and a plurality of filaments 313 received in the lamp tube 311. The top cap 312 is mounted on the top of the lamp tube 311. The lamp tube 311 has a bottom mounted in the mounting recess 327 of the pedestal 326. Each of the filaments 313 has an upper end secured to the lamp tube 311 and a lower end electrically connected with the electric contacts 328 of the position regulator 322.

In the preferred embodiment of the present invention, the dimmer 32 further includes a potentiometer 329 electrically connected with the electric contacts 328 of the position regulator 322. The potentiometer 329 is connected with the driving gear 323 and includes a dimming gear 330 secured to the driving gear 323 so that the dimming gear 330 of the potentiometer 329 is rotated in concert with the driving gear 323.

Figure 5:
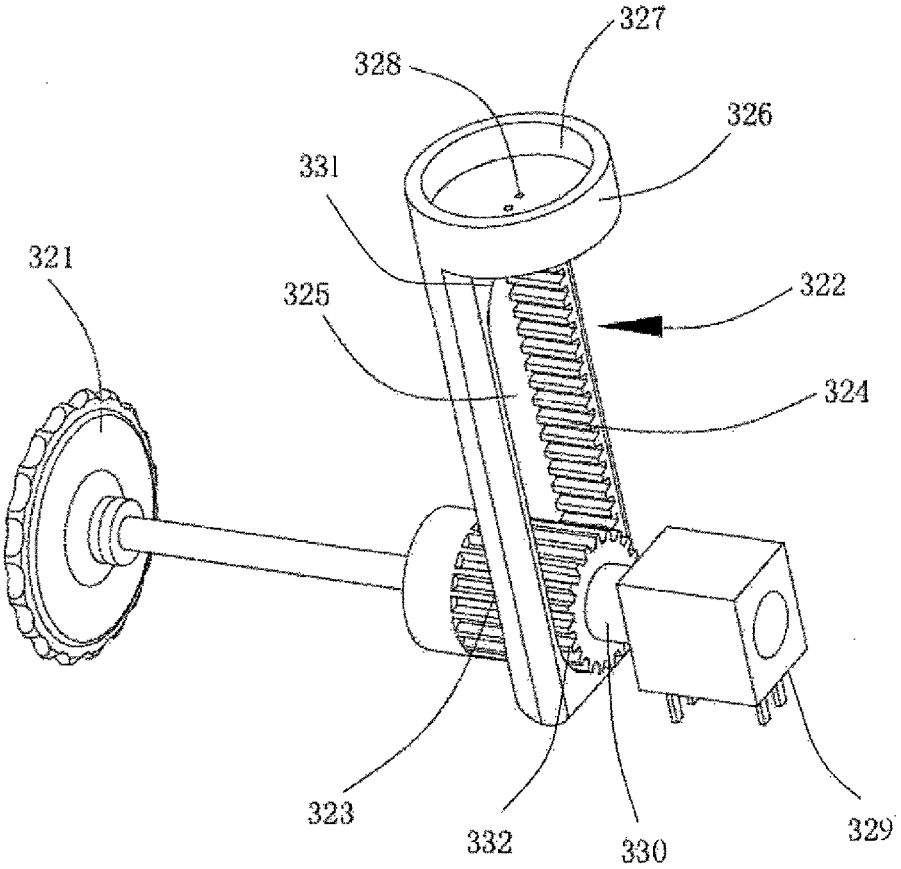
FIG. 5 is a perspective view of a dimmer of the lamp in accordance with the preferred embodiment of the present invention.
Figure 6:
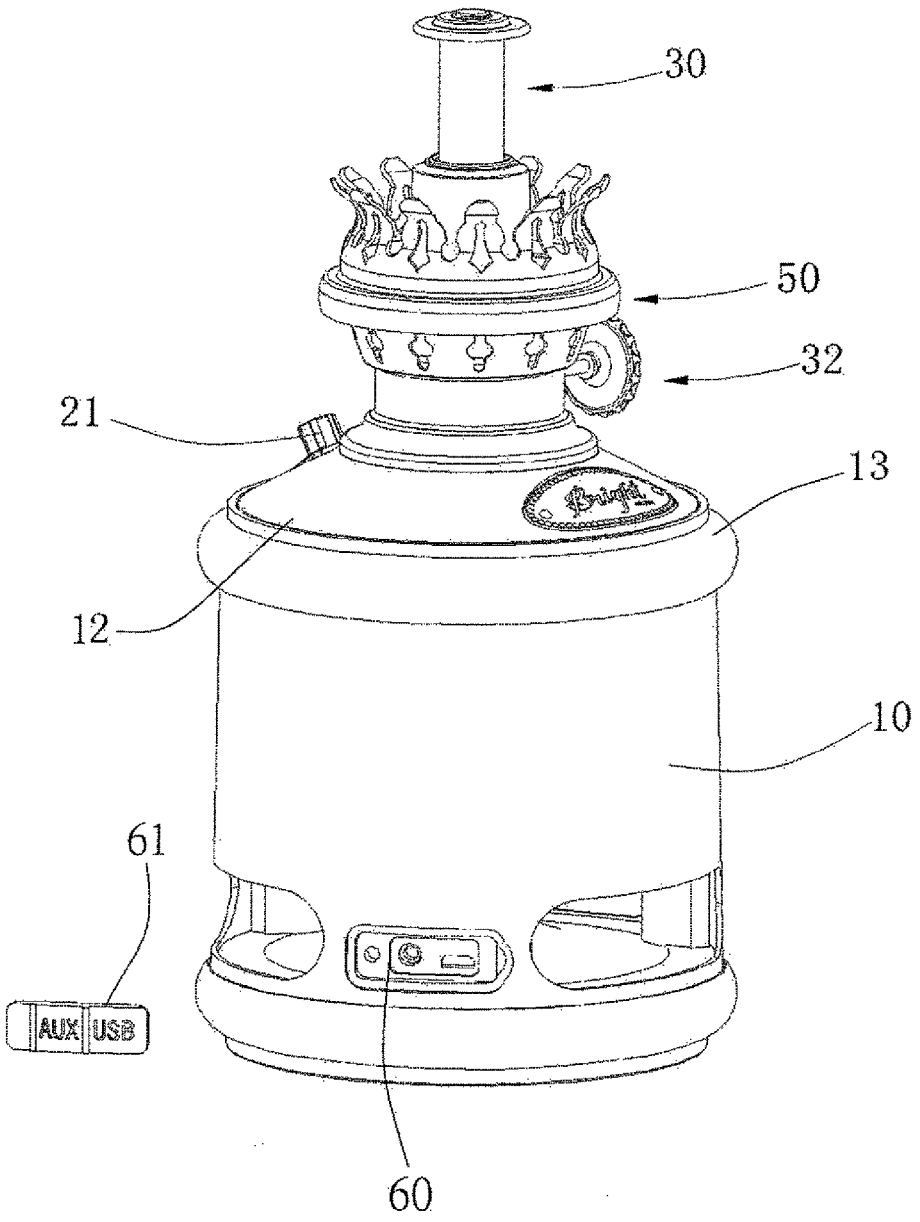
FIG. 6 is a partially exploded perspective view of the lamp in accordance with the preferred embodiment of the present invention.
Figure 7:
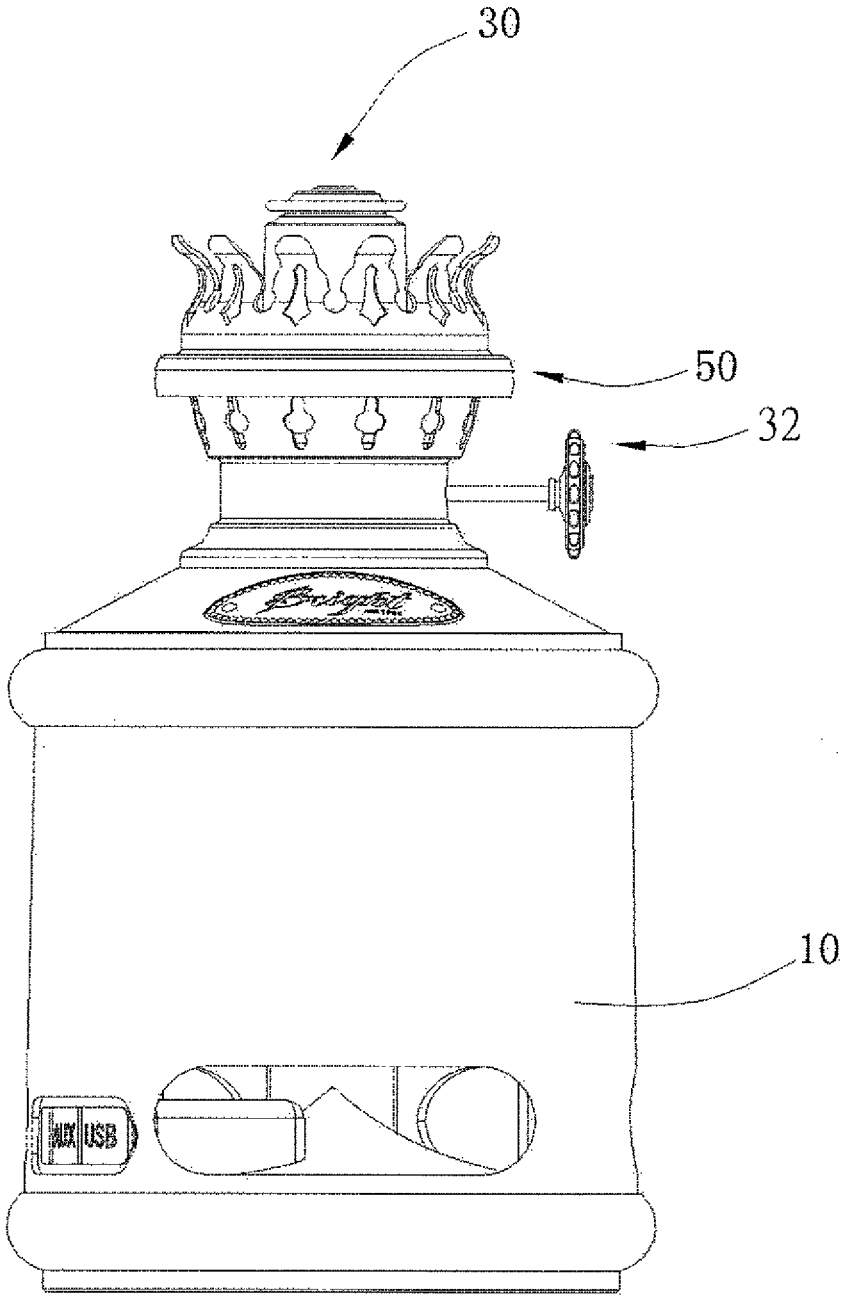
FIG. 7 is a partially perspective view of the lamp in accordance with the preferred embodiment of the present invention.

In operation, referring to FIGS. 6 and 7 with reference to FIGS. 1-5, when the rotary knob 321 is rotated, the driving gear 323 is rotated to move the toothed rack 324 which moves the position regulator 322 which moves the LED 31, so that the LED 31 is lifted to protrude outward from the housing 10 as shown in FIG. 6 or lowered to retract into the housing 10 as shown in FIG. 7. At this time, when the driving gear 323 is rotated, the dimming gear 330 of the potentiometer 329 is rotated in concert with the driving gear 323. In addition, the potentiometer 329 is electrically connected with the LED 31 by the electric contacts 328 of the position regulator 322.

In such a manner, when the driving gear 323 is rotated in the normal direction (such as clockwise) to lift the LED 31, the dimming gear 330 of the potentiometer 329 is also rotated in the normal direction, and the resistance of the potentiometer 329 is decreased gradually, so that the brightness the LED 31 is increased gradually. It is appreciated that, when the lower limit 332 of the toothed rack 324 is moved to rest on the driving gear 323 as shown in FIG. 5, the position regulator 322 stops moving, the LED 31 is located at the highest position as shown in FIG. 3, and the brightness the LED 31 has the maximum value.

On the contrary, when the driving gear 323 is rotated in the reverse direction (such as anticlockwise) to lower the LED 31, the dimming gear 330 of the potentiometer 329 is also rotated in the reverse direction, and the resistance of the potentiometer 329 is increased gradually, so that the brightness the LED 31 is decreased gradually. It is appreciated that, when the top cap 312 of the LED 31 is moved downward to rest on the top of the mounting seat 70, the LED 31 stops moving, while the position regulator 322 is successively moved downward, so that the bottom of the LED 31 is detached from the electric contacts 328 of the position regulator 322 to interrupt the connection between the LED 31 and the potentiometer 329, and to turn off the LED 31. In addition, when the upper limit 331 of the toothed rack 324 is moved to rest on the driving gear 323, the position regulator 322 stops moving.

When the driving gear 323 is again rotated in the normal direction, the position regulator 322 is moved upward, and the electric contacts 328 of the position regulator 322 are moved upward to contact the bottom of the LED 31 so as to connect the LED 31 with the potentiometer 329, and to turn on the LED 31.

Accordingly, the revival lamp provides illuminating and sound playing functions simultaneously to enhance the versatility of the revival lamp. In addition, the rotary knob 321 is rotated to lift or lower the LED 31 and to regulate the brightness the LED 31 so as to satisfy the user's requirement.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A lamp comprising:
a housing;
a sound assembly mounted in the housing;
a light assembly mounted in the housing and extending outward from a top of the housing; and
a lampshade mounted on the housing and covering the light assembly;
wherein:
the light assembly includes an LED and a dimmer electrically connected with the LED;
the dimmer includes a rotary knob, a position regulator and a driving gear;
the rotary knob is secured to the driving gear;
the position regulator has a side provided with an upright toothed rack meshing with the driving gear and has a top provided with a plurality of electric contacts;
the LED is detachably mounted on the position regulator and has a bottom electrically connected with the electric contacts of the position regulator;
when the driving gear is rotated by the rotary knob, the toothed rack is moved upward or downward, the position regulator is moved upward or downward, and the LED is lifted to protrude outward from the housing or lowered to retract into the housing;
the light assembly further includes a mounting seat mounted on the housing;
the LED is movable on the mounting seat;
the mounting seat has an interior provided with a channel;
the position regulator is movable upward or downward in the channel of the mounting seat;
the LED includes a top cap protruding outward from the mounting seat;
the top cap has a diameter greater than that of the channel; and
the top cap of the LED is moved downward to rest on a top of the mounting seat, with the bottom of the LED being detached from the electric contacts of the position regulator.

2. The lamp of claim 1, wherein:
the position regulator has an interior provided with an elongate slot;
the toothed rack is received in the elongate slot; and
the driving gear extends through the elongate slot.

3. The lamp of claim 2, wherein the toothed rack is provided with an upper limit that is movable to rest on the driving gear and a lower limit that is movable to rest on the driving gear.

4. The lamp of claim 1, wherein the housing includes a main body, an upper cover mounted on a top of the main body, and a mounting ring located between the main body and the upper cover.

5. The lamp of claim 4, wherein:
the main body has an outer face provided with an external thread;
the upper cover has an outer face provided with a limit plane; and
the mounting ring has an inner face having an upper end locked onto the limit plane of the upper cover and a lower end screwed onto the external thread of the main body.

6. The lamp of claim 1, further comprising:
an ornament assembly including a first decorative shell and a second decorative shell combined with each other;
wherein:
the first decorative shell is mounted on the upper cover of the housing; and
the second decorative shell is mounted on the lampshade.

7. A lamp comprising:
a housing;
a sound assembly mounted in the housing;
a light assembly mounted in the housing and extending outward from a top of the housing; and
a lampshade mounted on the housing and covering the light assembly;
wherein:
the light assembly includes an LED and a dimmer electrically connected with the LED;
the dimmer includes a rotary knob, a position regulator and a driving gear;
the rotary knob is secured to the driving gear;
the position regulator has a side provided with an upright toothed rack meshing with the driving gear and has a top provided with a plurality of electric contacts;
the LED is detachably mounted on the position regulator and has a bottom electrically connected with the electric contacts of the position regulator;
when the driving gear is rotated by the rotary knob, the toothed rack is moved upward or downward, the position regulator is moved upward or downward, and the LED is lifted to protrude outward from the housing or lowered to retract into the housing;
the top of the position regulator is provided with a pedestal having an interior provided with a mounting recess;
the electric contacts of the position regulator are located in the mounting recess of the pedestal; and
the bottom of the LED is mounted in the mounting recess of the pedestal.

8. A lamp comprising:
a housing;
a sound assembly mounted in the housing;
a light assembly mounted in the housing and extending outward from a top of the housing; and
a lampshade mounted on the housing and covering the light assembly;
wherein:
the light assembly includes an LED and a dimmer electrically connected with the LED;
the dimmer includes a rotary knob, a position regulator and a driving gear;
the rotary knob is secured to the driving gear;
the position regulator has a side provided with an upright toothed rack meshing with the driving gear and has a top provided with a plurality of electric contacts;
the LED is detachably mounted on the position regulator and has a bottom electrically connected with the electric contacts of the position regulator;
when the driving gear is rotated by the rotary knob, the toothed rack is moved upward or downward, the position regulator is moved upward or downward, and the LED is lifted to protrude outward from the housing or lowered to retract into the housing;

the dimmer further includes a potentiometer electrically connected with the electric contacts of the position regulator; and the potentiometer is connected with the driving gear and includes a dimming gear secured to the driving gear, with the dimming gear of the potentiometer being rotated in concert with the driving gear.

* * * * *